United States Patent [19]

Paige

[11] Patent Number: 4,976,467

[45] Date of Patent: Dec. 11, 1990

[54] LIQUID SPRAYING NOZZLE

[75] Inventor: Clive R. Paige, Berkshire, England

[73] Assignee: Shop-Vac Corporation, Williamsport, Pa.

[21] Appl. No.: 443,922

[22] Filed: Nov. 30, 1989

[51] Int. Cl.[5] ..... B05B 3/06

[52] U.S. Cl. ..... 239/381; 239/394

[58] Field of Search ..... 239/380, 381, 390, 394, 239/447, 448, 449, 391

[56] References Cited

U.S. PATENT DOCUMENTS

| | | | |
|---|---|---|---|
| 1,199,470 | 9/1916 | Leachtneauer | 239/394 |
| 2,388,093 | 10/1945 | Smith | 239/394 |
| 2,521,490 | 9/1950 | Strauss | 239/394 |
| 2,790,680 | 4/1957 | Rosholt | 239/394 |
| 3,112,885 | 12/1963 | Bell et al. | 239/394 |
| 3,516,611 | 6/1970 | Piggott | 239/394 |
| 3,704,831 | 12/1972 | Clark | 239/394 |
| 3,786,995 | 1/1974 | Manoogian et al. | 239/449 |
| 3,982,698 | 9/1976 | Anderson | 239/394 |
| 4,111,368 | 9/1978 | Brehm | 239/394 |
| 4,534,512 | 8/1985 | Chow et al. | 239/394 |
| 4,838,490 | 6/1989 | Nissels | 239/394 |

FOREIGN PATENT DOCUMENTS

| | | | |
|---|---|---|---|
| 883842 | 12/1961 | United Kingdom | 239/381 |

*Primary Examiner*—Andres Kashnikow

*Assistant Examiner*—Michael J. Forman

*Attorney, Agent, or Firm*—Ostrolenk, Faber, Gerb & Soffen

[57] ABSTRACT

A spraying device comprises a nozzle casing surrounding an interior which holds a nozzle block and a conduit coupler therein. The nozzle block and the coupler are axially aligned, a front wall of the coupler facing a rear wall of the nozzle block. The nozzle block and the coupler are relatively rotatable, enabling the front wall of the coupler to rotate relative to the rear wall of the nozzle block. A plurality of spray pattern forming apertures pass through the nozzle block, from the rear to the front wall thereof. A fluid passage in the coupler has a liquid outlet on the front wall of the coupler that is sealingly disposed against the rear wall of the nozzle block, eccentrically to the axis of rotation of the coupler in a manner which permits the liquid output to be brought into fluid communication with any one of the spray generating apertures. A comparatively large cylindrical bore which extends along the axis of the nozzle block forms a chamber which is open to the front wall of the nozzle block and is in fluid communication with one of the apertures. The chamber is designed to interchangeably hold therein either a nozzle insert which serves to generate one particular type of spray or a turbo assembly for generating a turbo or rotating liquid jet.

21 Claims, 2 Drawing Sheets

LIQUID SPRAYING NOZZLE

BACKGROUND OF THE INVENTION

The present invention relates to a liquid spraying nozzle and more particularly to a multi-mode nozzle capable of producing different, selectable spray patterns.

Many known multi-mode spraying nozzles have complex structures, are relatively expensive to produce and have limited versatility Many of these nozzles include means for selecting different spray outlets from the nozzle. Some permit outlet selection by rotating a multi-outlet spray head to align an outlet with a spray nozzle. Typically, the spray nozzles include a spray head which is not easily separable from and replaceable on the nozzle part which defines a water supply to the spray head.

Some spray nozzles include a rotating spray nozzle, in the form of a turbine, which spins as the liquid is sprayed to produce a conical or fanning out spray pattern. It is often difficult to assemble and disassemble such nozzles and their turbines. Also, compared to other types of spray generating structures, turbines are more complex and, therefore, the convention has been to provide special spray heads for turbines In other words, the prior art has not provided a standard spray head body which could be used interchangeably for turbine, as well as non-turbine applications.

SUMMARY OF THE INVENTION

It is a primary object of the present invention to provide a simple, versatile multi-spray mode, multi-outlet liquid spraying nozzle.

It is a further object of the present invention to provide a multi-mode liquid spraying nozzle which is simple, yet capable of producing several spray patterns.

It is a still further object of the present invention to provide a multi-mode liquid spraying nozzle of the aforementioned type which is capable, through the removable insertion therein of a turbo assembly, of a turbo spraying mode, i.e producing a rotating jet of liquid.

It is also an object of the present invention to provide a standard spraying nozzle body for a liquid spraying nozzle which body can be adapted for use with or without a turbo assembly.

Another object is to provide a spray nozzle which is easy and economic to assemble and produce.

The foregoing and other objects of the invention are realized by a spraying device which comprises a nozzle casing, a nozzle block and a conduit coupler. The nozzle casing is comprised of a peripheral wall which surrounds an axially extending interior. The nozzle block and the conduit coupler are cylindrically shaped and are disposed in the interior, and are in axial alignment, so that a front wall of the coupler faces a rear wall of the nozzle block While the nozzle block is held stationary, the coupler is rotatable relative to the casing, enabling the front wall of the coupler to rotate relative to the rear wall of the nozzle block.

A plurality of spray pattern forming apertures pass through the nozzle block, from the rear to the front wall thereof. Water can be directed into these apertures in the nozzle block from a liquid passageway in the coupler. That passageway has a liquid outlet on the front wall of the coupler, adjacent the inlets into the spray pattern forming apertures. The liquid outlet is disposed against and sealed against the rear wall of the nozzle block, eccentrically to the axis of rotation of the coupler in a manner which permits the liquid outlet to be selectively brought into fluid communication with any one of the spray pattern forming apertures.

A comparatively large bore extends along the axis of the nozzle block. The bore forms a cylindrical chamber which is open at the front wall of the nozzle and is in fluid communication with one of the spray forming apertures. The chamber is designed to hold therein interchangeably either a nozzle insert which serves to generate one particular type of spray pattern or a turbo assembly for generating a turbo or rotating liquid jet.

An external conduit, e g a water pipe, may be connected to the liquid passageway in the coupler by being screwed into an internally threaded conduit receptacle in the rear of the coupler, where the coupler is accessible through a rear opening in the nozzle casing.

A detent arrangement between the coupler and the casing permits nozzle rotation, i.e., relative rotation between the coupler and the casing, to be halted at selected angles of relative rotation to align the liquid outlet of the coupler against a selected spray generating aperture in the nozzle block.

Because leakage inside the holding chamber around either the nozzle insert or the turbine is likely, means are provided in the nozzle block to direct that leakage forward, harmlessly out of the front of the nozzle block, preventing rearward leakage and avoiding the possibility of creating a back pressure at the rear of either the nozzle insert or the turbo assembly.

Other features and advantages of the present invention will become apparent from the following description of the invention which refers to the accompanying drawings.

DETAILED DESCRIPTION OF THE DRAWINGS

Figures 1, 1A, 2, 2A, 2B:
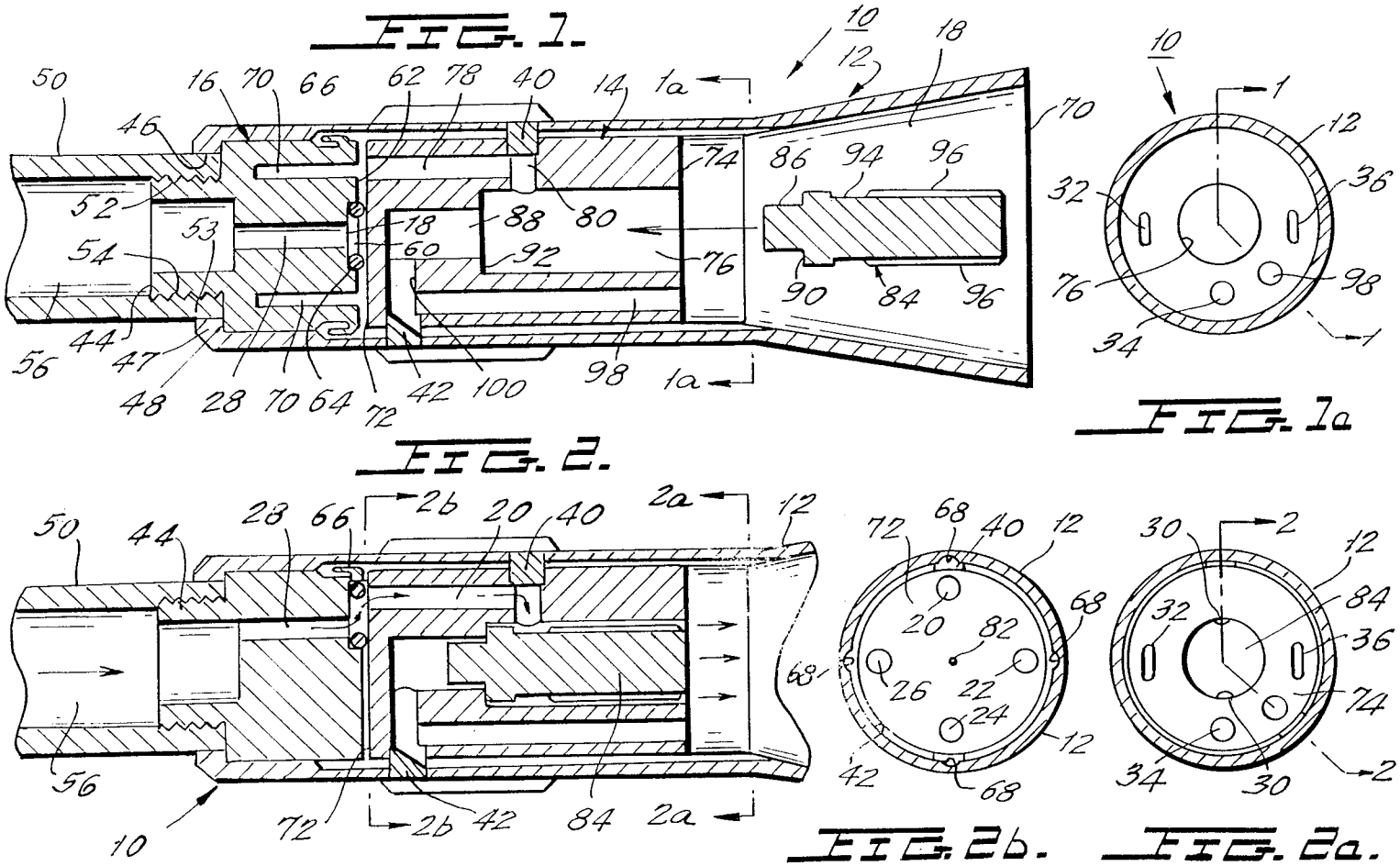
FIG. 1 is a cross-section through bent line 1—1 in FIG. 1*a*, of a first embodiment of a nozzle head of the present invention, showing a nozzle insert in position for being inserted into the nozzle head and a conduit coupler of the nozzle head in a first rotational position.
FIG. 1*a* is an end view in the direction of arrows 1*a*—1*a* in FIG. 1.
FIG. 2 is a cross-section showing the nozzle head of FIG. 1 with the nozzle insert in position within the nozzle head and the conduit coupler of the nozzle head rotated 90° relative to its position in FIG. 1.
FIG. 2*a* is an end view in the direction of arrows 2*a*—2*a* in FIG. 2.
FIG. 2*b* is an end view in the direction of arrows 2*b*—2*b* in FIG. 2.

Referring to FIGS. 1, 1*a*, 2, 2*a* and 2*b*, a multi-mode spray nozzle 10 of the present invention is essentially comprised of three parts, a nozzle casing 12, a nozzle block 14, and a water conduit coupler 16. The casing 12 surrounds and defines an axially extending interior in which the nozzle block 14 and the coupler 16 are disposed, in axial alignment. The front wall 62 of the coupler 16 faces the rear wall 72 of the nozzle block 14. While the nozzle block 14 is secured stationary in the interior, the casing 12 is permitted to rotate relative to the coupler 16.

A detent arrangement, described below, between the nozzle casing 12 and the coupler 16 halts their relative rotation at any one of four positions, in a manner permitting a liquid outlet 18 of a passageway 28 in the coupler 16 to be aligned with any of four different spray generating or spray pattern forming apertures 20, 22, 24 and 26 (FIG. 2*b*) which are formed in the nozzle block 14. Liquid directed into the apertures 20, 22, 24 and 26 emerges as a spray from corresponding spray outlets 30, 32, 34 and 36 shown in FIG. 2*a* and described below. Thus, by selectively aligning the liquid outlet 18 in the coupler 16 with one of the spray generating apertures 20, 22, 24 and 26 in the nozzle block 14, it is possible to spray out to liquid supplied through the passageway 28 a desired spray pattern.

The inlets into the apertures 20, 22, 24 and 26 are spaced off the center 82 on the rear wall 72 of the nozzle block 14 by approximately the distance by which the counterbore 60 around the liquid outlet 18 is displaced from the axis of rotation of the coupler 16. The passageway 28 and its outlet 18 therefore travel along an imaginary circle which is defined by the inlets into the apertures 20, 22, 24 and 26 as the coupler is rotated relative to the nozzle block 14.

The shallow counterbore 60 in the front wall 62 of the coupler 16 holds a forwardly projecting O-ring 64 that provides a seal around the liquid outlet 18 of the passageway 28.

The spray nozzle 10 is assembled by inserting into the casing 12, through the open, frustoconical antechamber 38 thereof, first the coupler 16 and then the nozzle block 14. The coupler 16 is disposed deep enough in the casing 12 so that the neck 44 of the coupler protrudes from the rear opening 46 of the casing 12. The inwardly depending annular flange 47 of the casing 12 slidably engages the annular shoulder 48 of the coupler 16, in a manner which retains the coupler 16 in the interior of the casing 12 without interfering with rotating the casing 12 together with the nozzle block 14 relative to the coupler 16. The nozzle block 14 is secured against extraction and rotation relative to the casing 12 by four snap fit elements 42 which protrude internally from casing 12 into receptacles therefor in the block 14.

Water can be supplied to the coupler 16 through a water supply conduit 50. That conduit 50 is comprised of a metal tube The tube has an outlet end portion 53 which is internally threaded at 52 to enable it to receive a corresponding externally threaded pipe extension 54 at the end of the neck 44 of the coupler 16. The metal conduit 50 has an axially extending bore 56 that extends to the outlet end of the conduit 50 to establish a continuous liquid path from the bore 56 in the conduit 50 to the off-center, small-diameter liquid passageway 28 in the coupler 16.

A detent arrangement between the coupler 16 and the casing 12 is comprised of four equally spaced raised detents 66 in the form of molded on fingers on the coupler 16. (Only one of the detents is seen because FIG. 1 is a cross-section along bent line 1—1 in FIG. 1*a*). These fingers 66 are disposed on the cylindrical outer peripheral wall of the coupler 16 for the purpose of cooperating with an equal number of correspondingly placed elongate channels 68 (FIG. 2*b*) which are notched into the interior peripheral surface of the nozzle casing 12 When the fingers 66 snap into the channels 68, they register the coupler 16 and the nozzle casing 12 at any of four different predetermined rotational positions for selecting a spray pattern.

A pair of slits 70 extend from the front wall 62 into the coupler 16 to allow the resilient material coupler to be compressed inwardly during its insertion into the casing 12 so as to avoid interference from the raised detents 66 as the nozzle 10 is being assembled.

The wall comprising the nozzle casing 12 is cylindrical where it surrounds the coupler 16 and the nozzle block 14 and is frustoconical where it defines the antechamber 38. However, that wall may have other shapes at the antechamber 38, including a cylindrical cross-section of the same diameter as the portion over the coupler 16 or even a "racetrack" shaped cross-section, becoming gradually taller, with straight, flat sides and rounded top and bottom ends (not shown), so long as the opening 70 into the casing 12 is kept large enough to permit the coupler 16 and the nozzle block 14 to be inserted into the interior of the casing 12 therethrough.

Three of the four spray pattern forming apertures 22, 24 and 26 extend through the nozzle block 14, parallel or nearly parallel to its axis. Each of these apertures has an inlet (see FIG. 2*a*) at the rear wall 72 of the nozzle block 14 and a corresponding spray emitting outlet 32, 34 and 36 (see FIG. 1*a*) at the front wall 74 thereof Each of the apertures 22, 24 and 26 is shaped to generate a particular type of spray pattern, e.g. high pressure, low pressure and fan shaped, etc.

For a purpose which will soon become apparent, the aperture 20 extends from its inlet at the front wall 72 into an axially extending, elongate and cylindrical chamber 76 formed in the center of the nozzle block 14. The aperture 20 is comprised of a horizontal section 78 and a vertical section 80. For ease of manufacturing, the vertical section 80 is formed so that it extends radially all the way through the nozzle block 14 and is thereafter closed off at the end thereof near the casing 12 by the spun welded pin 40.

In accordance with a first embodiment of the invention (FIGS. 1 and 2), the chamber 76 in the nozzle block 14 is designed to receive and hold a nozzle insert 84. A neck portion 86 of the nozzle insert 84 is received in a rear, reduced diameter extension 88 of the chamber 76. The annular shoulder 90 of the insert 84 abuts a similarly shaped rear shoulder 92 in the chamber 76 and registers an annular water inlet 94 in the insert 84 with the vertical section 80 of the aperture 20. Water therefore flows into the annular water inlet 94 and out through a pair of spray outlets 30 which are defined by diametrically opposed troughs 96 in the insert 84 and the interior surface of the block 14.

Each of the apertures 20, 22, 24 and 26 is thus suited for generating a particular spray pattern. For example, the aperture 20 is designed for producing a relatively high pressure dual jet through its cooperation with the troughs 96 of nozzle insert 84. The second aperture 22 may produce a lower pressure, fan jet for chemical injection The third aperture 24 may produce a high-/medium pressure, angled jet and the fourth aperture 26 a higher pressure fan jet.

Selecting a desired spray pattern is accomplished by rotating the nozzle casing 12 with the nozzle block 14, while the coupler 16 and water supply conduit 50 remain stationary as they are held fixed to a liquid source (not shown) from which liquid is delivered to the conduit 50.

Water may leak around the periphery of the nozzle insert 84. Leakage flow can be tolerated out the front of the nozzle 10 but not out of its rear as back leakage would undesirably produce a back pressure against the nozzle insert 84 Difficulties from leakage are, however, avoided by the leakage conduit 98 in the nozzle block 14 which provides a water leakage path from the rear extension 88 of the chamber 76 to the front wall 74 of the nozzle block 14 Like the aperture 20, the leakage conduit 98 is comprised of axial and radial sections Its radial section 100 extends radially through the nozzle block 14.

Each of the components of the nozzle 10 of the present invention is structurally simple. The assembly of these components requires no more than the insertion of the coupler 16 and the nozzle block 14 into the casing 12. The coupler 16 also serves to press the O-ring 64 against the rear wall 72 of the block 14 to provide a tight liquid seal between the passageway 18 of the coupler 16 and the selected one of apertures 20, 22, 24 and 26. Simply rotating the casing 12 relative to the coupler 16 enables registration of the detents 66 of the coupler 16 with the channels 68 in the casing 12 to select any of the four available spray patterns.

Figure 3:
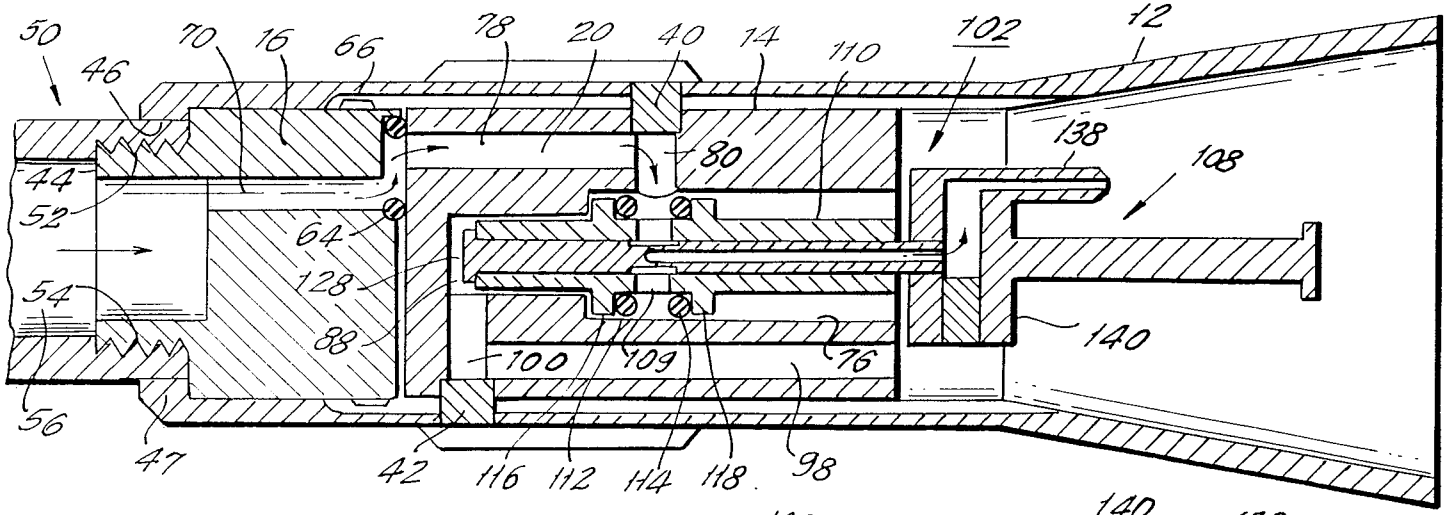
FIG. 3 is a cross-section of a second embodiment of the invention which provides a turbo assembly in place of the nozzle insert.
Figure 4:
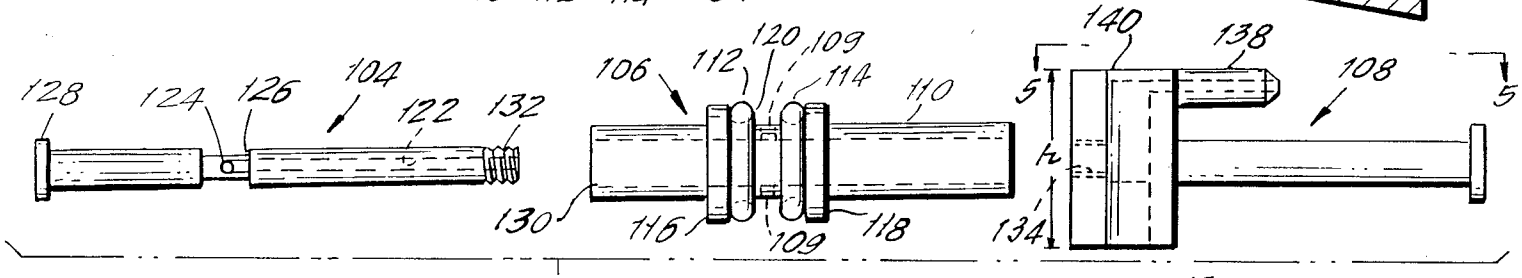
FIG. 4 is an exploded view of the turbo assembly of FIG. 3.
Figure 5:
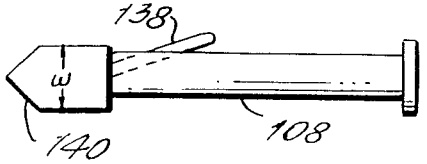
FIG. 5 is a view in the direction of arrows 5—5 in FIG. 4.

FIGS. 3–5 show a second embodiment of the invention which differs from the first embodiment in the inclusion of a turbine assembly 102, which is removably positioned in the chamber 76 for producing a turbo spray pattern, and which is provided in place of the nozzle insert 84. Those reference numbers in FIGS. 3–5 which also appear in the previous Figures designate identical elements and are not further described.

As seen in FIG. 4, the turbo assembly 102 is comprised of three components including a spindle 104, a sleeve 106 and spindle head 108. The spindle 104 passes through the sleeve 106 and is insert molded to the spindle head 108. The exterior diameter of the spindle 104 is very slightly smaller than the interior diameter of the sleeve 106, allowing the spindle 104 to rotate within the sleeve 106.

The sleeve 106 has an outer wall 110 on which first and second longitudinally spaced O-ring seals 112 and 114 are placed, abutting respective first and second ribs 116 and 118 around the sleeve 106. The seals 112 and 114 define a water inlet chamber 120 located axially between them and those seals flank a water inlet orifice 109 which communicates into the hollow interior of the sleeve 106. As seen in FIG. 3, the water inlet chamber 120 is longitudinally located to be in sealed fluid communication with the outlet of the vertical section 80 of the aperture 20, enabling water to flow from the conduit 50 all the way into the sleeve 106, when the coupler 16 and block 14 are rotationally oriented as in FIG. 3.

Water entering the sleeve 106 flows into the interior bore 122 in the spindle 104, through an inlet orifice 124 That orifice 124 is disposed in an annular groove 126 around the spindle 104. The groove 126 is axially aligned with the water inlet chamber 120 in the sleeve 106, when the spindle 104 is fully inserted into the sleeve 106, such that the spindle stop 128 thereof lies against the rear end 130 of the sleeve 106.

The spindle 104 is axially long enough to enable its front portion 132 to protrude from the front end of the sleeve 106 for being molded into the receptacle 134 in the rear of the spindle head 108.

In FIG. 3, the turbo assembly 102 is shown installed in the chamber 76 with the water inlet chamber 120 of the sleeve 106 in fluid communication with the vertical section 80 of the aperture 30. Water that enters the bore 122 of the spindle 104 flows toward the spindle receptacle 134 in the spindle head 108, passes through an internal, radial passageway 136, and exits the spindle head 108 from an eccentric and obliquely oriented outlet spray nozzle 138 The eccentricity of the nozzle 138 and its oblique left or right, i.e. across the axis, aim are such that the reaction force of the water spraying out of the spindle head 108 causes the head 108 to spin together with the spindle 104 relative to the normally stationary sleeve 106.

FIGS. 4 and 5 show the spindle head 108 at rotated positions 90 degrees apart to illustrate that the head 108 has a narrow radial width (FIG. 5) and a comparatively greater radial height (FIG. 4). The narrow radial width ("w" in FIG. 5) of the spindle head 104 should be smaller than the distance from the center of the chamber 76 to the spray outlets 32, 34 and 36 on the front wall 74 of the block 14 (FIG. 2*a*) so as not to block the path of exiting water when any one of the spray outlets 32, 34, and 36 is in use For the same purpose, the spindle head 108 has a left, i.e. rear end, portion 140 which is wedge or triangle shaped, with the apex or sharp end of the wedge facing rearwardly. This enables water exiting from any of the outlets 32, 34, or 36 to strike the rear wedge shaped end of the head 108 to rotate it enough to be out of the path of the spraying water. In contrast, the radial height ("h" in FIG. 4) can be larger, closer in size to the internal diameter of the casing 12, which provides certain advantages.

The turbo assembly 102 can be easily disassembled for cleaning, repair, etc The entire turbo assembly 102 may be pulled out of the chamber 76 to allow the spindle head 108 and the spindle 104 to be removed from the sleeve 106.

As for the nozzle insert 84, the leakage conduit 98 serves to direct leakage around the turbo assembly 102 toward the front, preventing the development of an undesired back pressure against the rear of the turbo assembly 102.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A spraying nozzle, comprising:

a nozzle casing having a peripheral wall which surrounds an interior, the casing having a rear opening, a front opening, and a rotation axis;

a conduit coupler in the interior of the casing, and a conduit securing means in the coupler for securing a liquid supplying conduit to the coupler, the conduit securing means being accessible at the rear opening of the casing, the coupler further having a front wall;

a nozzle block completely within the casing interior forward of and in axial alignment with the conduit coupler, the nozzle block having a rear wall facing the front wall of the coupler, the conduit coupler and the nozzle block being relatively rotatable about the rotation axis, means for connecting the casing and nozzle block such that rotation of the nozzle casing with respect to the conduit coupler causes relative motion of the nozzle block and and conduit coupler;

a plurality of different spray generating apertures defined in and extending through the nozzle block from the rear wall thereof toward the front opening of the nozzle casing and discharging into the interior of the casing, the apertures having inlets at the rear wall of the nozzle block and these inlets being spaced apart along an imaginary circle on the rear wall; and a liquid passageway in the coupler, the passageway having a liquid outlet which is sealingly disposed against the rear wall of the nozzle block, eccentric relative to the rotation axis in a manner permitting the liquid outlet to be placed in sealed liquid flow communication with any selected one of the spray apertures upon rotation of the conduit coupler and the nozzle casing relative to one another.

2. The spraying nozzle of claim 1, wherein the coupler is cylindrical.

3. The spraying nozzle of claim 1, wherein essentially the entirety of the coupler is disposed within the interior of the nozzle casing.

4. The spraying nozzle of claim 1, wherein the coupler has a rear wall facing away from the coupler front wall, the conduit securing means being disposed at the rear wall of the coupler and effective for securing the liquid supplying conduit to the coupler, the liquid passageway in the coupler extending from the conduit securing means to the front wall of the coupler.

5. The spraying nozzle of claim 4, wherein the conduit securing means comprises a threaded receptacle in the coupler.

6. The spraying nozzle of claim 4, further comprising a seal surrounding the liquid outlet and engaging both the front wall of the coupler and the rear wall of the nozzle block for effecting a seal between the liquid outlet and the rear wall of the nozzle block.

7. The spraying nozzle of claim 6, further comprising a counterbore in the front wall around the liquid outlet in the coupler, the counterbore defining the liquid outlet and the O-ring seal being disposed in the counterbore.

8. The spraying nozzle of claim 1, further comprising rotation position setting means for selecting the rotation position of the coupler relative to any of a plurality of predetermined positions each corresponding to alignment of a respective spray aperture with the liquid outlet of the coupler.

9. The spraying nozzle of claim 8, wherein the rotation position setting means comprises a plurality of radially projecting detents on the coupler and a corresponding number of channels in the nozzle casing for receiving the detents therein.

10. The spraying nozzle of claim 1, wherein the nozzle block comprises a front wall and an axially extending, elongate chamber which has an opening at the front wall of the nozzle block, at least one of the spray apertures leading from the rear wall of the nozzle block into the chamber.

11. The spraying nozzle of claim 10, further including a nozzle insert removably disposed in the chamber.

12. The spraying nozzle of the claim 11, wherein the nozzle insert has defined therein liquid channels and the liquid channels are located to be in liquid communication with the at least one of the spray apertures.

13. The spraying nozzle of claim 10, further comprising a leakage conduit having an inlet in fluid communication with a rear region of the chamber and a leakage conduit outlet disposed nearer a front region of the chamber.

14. The spraying nozzle of claim 1, further comprising notches in an exterior surface of the coupler effective for permitting the cross-section size of the coupler to be reduced to enable the coupler to be inserted into the interior of the nozzle casing.

15. A spraying nozzle, comprising:

a nozzle casing having a peripheral wall which surrounds an interior, the casing having a rear opening, a front opening, and a rotation axis;

a conduit coupler in the interior of the casing, and a conduit securing means in the coupler for securing a liquid supplying conduit to the coupler, the conduit securing means being accessible at the rear opening of the casing, the coupler further having a front wall;

a nozzle block in the casing interior forward of and in axial alignment with the conduit coupler, the nozzle block having a rear wall facing the front wall of the coupler, the conduit coupler and the nozzle block being relatively rotatable about the rotation axis, means for connecting the casing and nozzle block such that rotation of the nozzle casing with respect to the conduit coupler causes relative motion of the nozzle block and conduit coupler;

a plurality of spray generating apertures defined in and extending through the nozzle block from the rear wall thereof toward the front opening of the nozzle casing and discharging into the interior of the casing, the apertures having inlets at the rear wall of the nozzle block and these inlets being spaced apart along an imaginary circle on the ear wall;

a liquid passageway in the coupler, the passageway having a liquid outlet which is sealingly disposed against the rear wall of the nozzle block, eccentric relative to the rotation axis in a manner permitting the liquid outlet to be placed in sealed liquid flow communication with any selected one of the spray apertures upon rotation of the conduit coupler with respect to the nozzle casing;

a turbo holding chamber defined in the nozzle block, the turbo holding chamber having a rear region and a front region; and a turbo assembly disposed within the turbo holding chamber and including a rotatable turbo body and a spray nozzle coupled to the rotatable body and oriented for directing a spray off an axis of rotation of the turbo assembly, the rotatable turbo body being rotatable by the reaction force of spray through the nozzle; a liquid delivery pathway in the turbo assembly being in liquid flow communication with a selected one of the apertures for delivering liquid to be sprayed by the turbo assembly.

16. The spraying nozzle of claim 15, further including a leakage conduit having an inlet in fluid communication with the rear region of the turbo holding chamber and a leakage conduit outlet disposed nearer the front region of the turbo holding chamber.

17. The spraying nozzle of claim 16, wherein the turbo assembly comprises a sleeve sealingly disposed in the turbo holding chamber and a spindle which comprises the rotatable turbo body and which is disposed in and rotatable within the sleeve.

18. The spraying nozzle of claim 17, further comprising a spindle head connected to and rotatable with the spindle, the head including the eccentrically arranged nozzle.

19. The spraying nozzle of claim 18, wherein the spindle head has a wedge shaped rear surface facing the spindle for being struck by liquid to orient the spindle head not to block liquid flowing out any of the spray generating apertures.

20. The spraying nozzle of claim 18, wherein the sleeve carries a pair of O-rings sealingly straddling an inlet into the liquid flow pathway for defining a liquid inlet chamber at the sleeve.

21. The spraying nozzle of claim 15, wherein the conduit securing means is accessible at the rear opening of the nozzle casing.

* * * * *